US011616312B2

(12) United States Patent
Leigh et al.

(10) Patent No.: US 11,616,312 B2
(45) Date of Patent: Mar. 28, 2023

(54) ELECTRICAL SOCKET HAVING A PLURALITY OF WIRE-TERMINATED CONTACTS

(71) Applicant: Hewlett Packard Enterprise Development LP, Houston, TX (US)

(72) Inventors: Kevin B. Leigh, Houston, TX (US); John Norton, Houston, TX (US)

(73) Assignee: Hewlett Packard Enterprise Development LP, Spring, TX (US)

( * ) Notice: Subject to any disclaimer, the term of this patent is extended or adjusted under 35 U.S.C. 154(b) by 115 days.

(21) Appl. No.: 17/249,229

(22) Filed: Feb. 24, 2021

(65) Prior Publication Data

US 2022/0271452 A1 Aug. 25, 2022

(51) Int. Cl.

*H01R 12/57* (2011.01)
*H01R 12/52* (2011.01)
*H01R 12/53* (2011.01)

(52) U.S. Cl.

CPC ..... *H01R 12/523* (2013.01); *H01R 12/53* (2013.01); *H01R 12/57* (2013.01)

(58) Field of Classification Search

CPC ..... H01R 12/523; H01R 12/53; H01R 12/57
See application file for complete search history.

(56) References Cited

U.S. PATENT DOCUMENTS 6,264,476 B1 7/2001 Li et al.
6,990,733 B2 1/2006 Lopata et al.
2006/0084288 A1 4/2006 Chuang et al.
2009/0253279 A1* 10/2009 Howell ..... H01R 13/33 439/82
2012/0058655 A1* 3/2012 Chien ..... H01R 12/585 439/78
2014/0087592 A1* 3/2014 Endo ..... H01R 12/91 439/628
2016/0226203 A1* 8/2016 Bradley ..... H01R 43/26
2018/0040971 A1* 2/2018 Phillips ..... H01R 12/737
2018/0287277 A1* 10/2018 Lybrand ..... H01R 12/515
2019/0097356 A1* 3/2019 Horning ..... H01R 13/502
2020/0021050 A1* 1/2020 Tu ..... H01R 12/7076
2020/0229305 A1* 7/2020 Elsing ..... H05K 1/144

FOREIGN PATENT DOCUMENTS

JP 2000113951 4/2000

OTHER PUBLICATIONS

Amphenol ICC; "Learn About Connector Termination Styles"; Apr. 20, 2020; 3 pages.

* cited by examiner

*Primary Examiner* — Truc T Nguyen
(74) *Attorney, Agent, or Firm* — Hewlett Packard Enterprise Patent Department

(57) ABSTRACT

Example implementations relate to an electrical socket for an electronic packaging assembly, which accepts a modular integrated circuit (IC) on one side and a circuit board on another side. In some examples, the electrical socket has a first body mountable on a first surface of the circuit board and a second body mountable on a second surface of the circuit board. The first body includes a plurality of conductors (wire-terminated contacts), where each first conductor includes a first end to protrude beyond the first surface of the circuit board and a second end to protrude beyond the second surface of the circuit board. The second body includes a plurality of receptacles, where each receptacle is coupled to the second end of a respective first conductor.

19 Claims, 5 Drawing Sheets

ELECTRICAL SOCKET HAVING A PLURALITY OF WIRE-TERMINATED CONTACTS

BACKGROUND

Integrated circuits (ICs) are typically housed within an electronic socket of an electronic packaging assembly, which is designed to retain the ICs from damage, provide adequate heat dissipation during operation, and provide electrical connection between the ICs and a circuit board via a plurality of conductors of the electrical socket. Several types of electronic sockets, such as a ball grid array (BGA) socket, or a column grid array (CGA) socket are designed to provide the above functions.

BRIEF DESCRIPTION OF THE DRAWINGS

Various examples will be described below with reference to the following figures.

DETAILED DESCRIPTION

Figure 1:
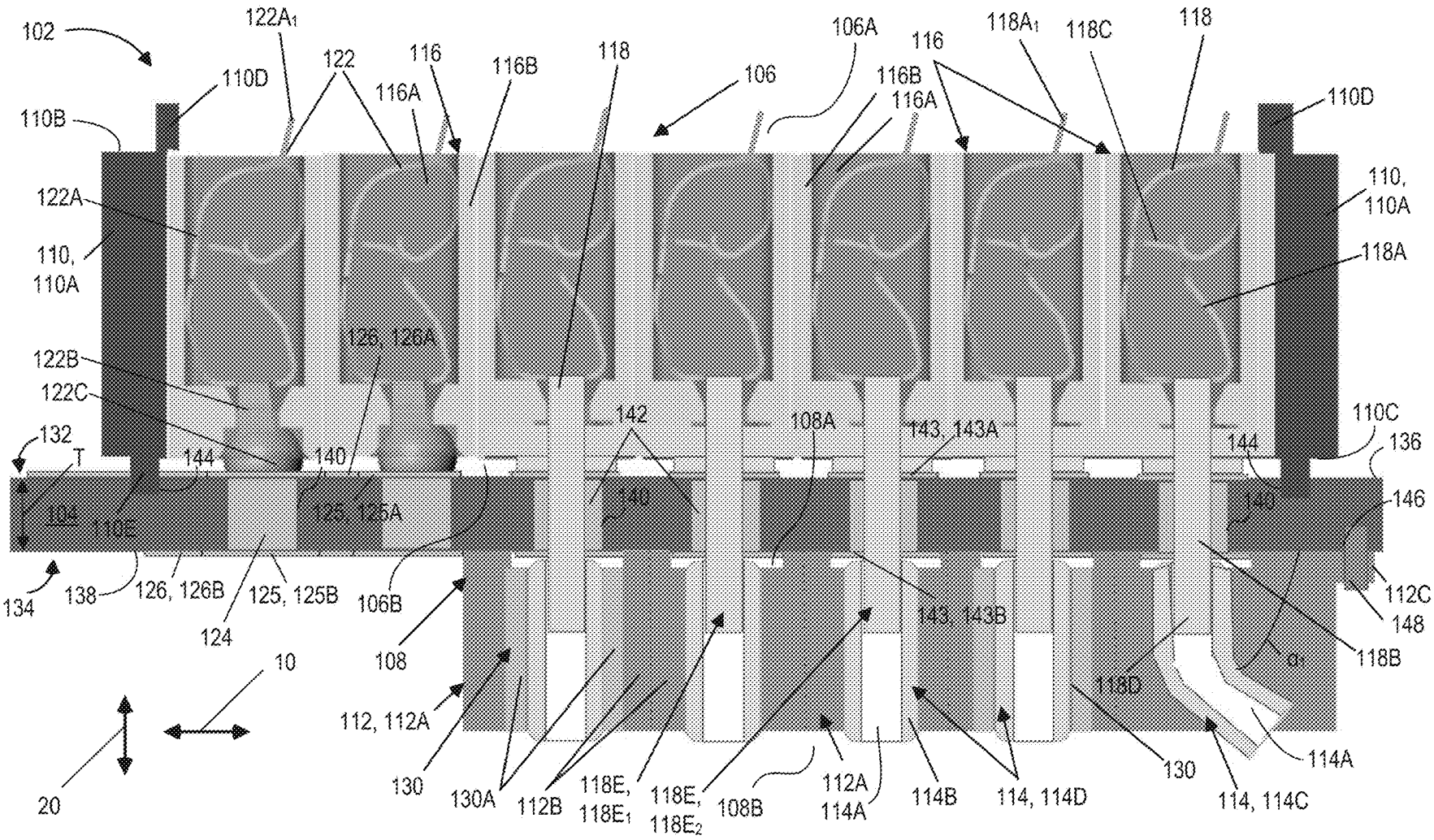
FIG. 1 illustrates a cross sectional view of an electronic socket mounted on a circuit board of an electronic packaging assembly according to an example implementation of the present disclosure.

The following detailed description refers to the accompanying drawings. Wherever possible, the same reference numbers are used in the drawings and the following description to refer to the same or similar parts. It is to be expressly understood, however, that the drawings are for the purpose of illustration and description only. While several examples are described in this document, modifications, adaptations, and other implementations are possible. Accordingly, the following detailed description does not limit the disclosed examples. Instead, the proper scope of the disclosed examples may be defined by the appended claims.

The terminology used herein is for the purpose of describing example embodiments only and is not intended to be limiting. As used herein, the singular forms "a," "an," and "the" are intended to include the plural forms as well, unless the context clearly indicates otherwise. The term "plurality," as used herein, is defined as two, or more than two. The term "another," as used herein, is defined as at least a second or more. The term "coupled," as used herein, is defined as connected, whether directly without any intervening elements or indirectly with at least one intervening elements, unless otherwise indicated. Two elements may be coupled mechanically, electrically, or communicatively linked through a communication channel, pathway, network, or system. The term "and/or" as used herein refers to and encompasses any and all possible combinations of one or more of the associated listed items. It will also be understood that, although the terms first, second, third, etc. may be used herein to describe various elements, these elements should not be limited by these terms, as these terms are only used to distinguish one element from another unless stated otherwise or the context indicates otherwise. As used herein, the term "includes" means includes but not limited to, the term "including" means including but not limited to. The term "based on" means based at least in part on.

As used herein, the term "electronic system" may refer to compute infrastructure, for example, a networking system, which includes a network switch and an electronic packaging assembly, for example, an optical transceiver for transmitting, receiving, or processing data. As used herein, the term "electronic packaging assembly" may refer to an electronic enclosure of devices ranging from individual semiconductor device, such as an optical transceiver to a complete system, such as a mainframe computer. As used herein, the term "electronic socket" may refer to a type of connector in the electronic package assembly, for interconnecting an integrated circuit device to a printed circuit board via mechanical connectors, such as support elements, and electrical connectors, such as a plurality of first and second conductors. The term "receptacle" may refer to a solid component of the electronic socket, having a cavity (through cavity) for receiving and containing the plurality of conductors and/or providing electrical connections between plurality of first and second conductors. As used herein, the term "protrude beyond" may refer to an end portion of the conductor overhanging above/below a surface of an object, for example, the circuit board. Further, the term "wire-terminated contacts" may refer to the end portion of the conductors that is laying freely beyond the surface of the object.

The present disclosure describes example implementations of an electrical socket for an electronic packaging assembly, which accepts an integrated circuit (IC) on one side and a circuit board on another side. In some examples, the electrical socket has a first body mountable on a first surface of the circuit board and a second body mountable on a second surface of the circuit board. The first body includes a plurality of conductors (or wire-terminated contacts), where each conductor of the plurality of conductors includes a first end to protrude beyond the first surface of the circuit board and a second end to protrude beyond the second surface of the circuit board. The second body includes a plurality of receptacles, where each receptacle of the plurality of receptacles is coupled to the second end of a respective first conductor.

For purposes of explanation, certain examples are described with reference to the components illustrated in FIGS. 1-5. The functionality of the illustrated components may overlap, however, and may be present in a fewer or greater number of elements and components. Further, all or part of the functionality of illustrated elements may co-exist or be distributed among several geographically dispersed locations. Moreover, the disclosed examples may be implemented in various environments and are not limited to the illustrated examples. Further, the sequence of operations performed for assembling the electronic socket on a circuit board described in connection with FIG. 5 is an example and is not intended to be limiting. Additional or fewer operations or combinations of operations may be used or may vary without departing from the scope of the disclosed examples. Thus, the present disclosure merely sets forth possible examples of implementations, and many variations and modifications may be made to the described examples. Such modifications and variations are intended to be included within the scope of this disclosure and protected by the following claims.

An electronic system, for example, a networking system may include an electronic packaging assembly, for example, an optical transceiver and a network switch for transferring, receiving, or processing data. The optical transceiver may include an integrated circuit (IC) device (e.g., an input output (IO) application specific integrated circuit (ASIC)), an electronic socket, a circuit board, and a receptacle connector. Similarly, the network switch may include a switch ASIC, a switch connector, and a printed circuit board. In such examples, the IO ASIC may be housed within the electronic socket mounted on the circuit board, and connected to pads of the circuit board via conductor probes of the electronic socket. Further, the receptacle connector disposed at along an end portion of the circuit board is connected to the pads through traces in the circuit board. Similarly, the switch connector disposed at along end portion of the printed circuit board is connected to the switch ASIC through traces in the printed circuit board. In such examples, the optical transceiver may be communicatively coupled to the network switch via a cable interconnecting the receptacle connector and the switch connector. However, when the IO signals from the IO ASIC need to be routed to the switch ASIC through the receptacle connector, the interconnecting cable, and the switch connector, the conductor probes in the electronic socket may require to first route the signals via traces to the receptacle connector. The routing of the signals through the traces has issues related to maintaining signal integrity, especially for the signals which are routed at a substantially high data transfer rates (e.g., ≥100 Gbps). Further, the traces may occupy additional space in the circuit board, which typically has a space constraint within the electronic system. Additionally, the use of traces may require additional receptacle connectors and multiple circuit boards, when arrays of the optical transceivers are required to be positioned in multiple rows in the electronic system.

A technical solution to the aforementioned problems may include providing an electronic socket having wire-terminated contacts (i.e., first conductors) to interconnect with a cable plug through cables (i.e., second conductors), instead of interconnecting the conductor probes to the receptacle connector via the traces. Thus, the wire-terminated contacts of the electronic socket may allow an IO ASIC of an electronic packaging assembly (e.g., an optical transceiver) to be connected to the cable plug through the first and second conductors. In one or more examples, the cables may reduce signal power losses by an order of magnitude when compared to the traces of the circuit board. Thus, by replacing the traces with the second conductors for the purpose of interconnecting the IO ASIC to the cable plug, a high-speed electrical signal connectivity may be achieved, while not incurring signal losses associated with the traces, and issues related to space and cost of having traces in the circuit board for routing signals in and out of the IO ASIC. Further, the multiple rows of optical transceivers may also be more flexibly placed in an electronic system. In one example, the electronic socket is a land grid array (LGA) socket. In some other examples, the electronic socket may be a pin grid array (PGA) socket or the like.

In some examples, the cable plug of the electronic packaging assembly is further coupled to a switch receptacle connector of a network switch, where the switch receptacle connector is further coupled to a switch ASIC of the network switch. Thus, in accordance to one or more examples of the present disclosure, the electronic packaging assembly is communicatively coupled to the network switch through the cable plug and switch receptacle connector.

The electronic socket may further include a plurality of ball grid array (BGA) contacts (i.e., conductor probes) coupled to the traces in the circuit board, Thus, the electronic socket having the ability to mix the wire-termination contacts (conductors) and the BGA contacts (conductor probes) makes the electronic socket well equipped to handle power conversions/regulations and management of electrical signals having low data rates as well as substantially high data transfer rates. In other words, the BGA contacts may allow power conversion/regulation devices to be present on the circuit board as well as low-speed management of electrical signals, while the wire-terminated contacts may allow the high-speed electrical signals to be routed without using the traces on the circuit board. Thus, the electronic socket of the present disclosure may allow separating the processing and management capabilities from the electrical signal connectivity capability of the circuit board. Further, the electronic socket having a flexible population of the BGA contacts and the wire-terminated contacts may enable such electronic socket to have a wide application base.

FIG. 1 depicts a cross sectional view of an electronic socket 102 mounted on a circuit board 104 of an electronic packaging assembly 100 (refer to FIGS. 2 and 4), In some examples, the electronic packaging assembly 100 is an optical transceiver.

The electronic socket 102 is a connector having one or more elements to provide mechanical and electrical connections there between an integrated circuit (IC) device, for example, an input output (IO) application specific integrated circuit (ASIC) and the circuit board 104. In other words, the electronic socket 102 may be configured to retain the IO ASIC, provide support for heat dissipation during operation of the IO ASIC, and provide electrical connection i) between the IO ASIC and the circuit board 104 or ii) from the IO ASIC to one or more downstream components (discussed below), In one or more examples, the electronic socket 102 may allow placing or replacing of the IO ASIC without soldering it to the circuit board 104, In some examples, the electronic socket 102 is a land grid array (LGA) socket. In some other examples, the electronic socket 102 may be a pin grid array (PGA) socket, or the like.

The electronic socket 102 includes a first body 106 and a second body 108, which are discrete portions of the electronic socket 102, and which are mountable on the circuit board 104. The first body 106 and the second body 108 are disposed spaced apart from each other, when the electronic socket 102 is mounted on the circuit board 104.

In some examples, the first body 106 is configured to hold a portion of the electronic socket 102. The first body 106 has a first open end 106A and a second open end 1063. In some examples, the first open end 106A may be configured to receive the IO ASIC and the second open end 106B may be mounted on the circuit board 104. The first body 106 has a first support element 110, a plurality of receptacles 116 (also referred to herein as "second receptacles"), a plurality of first conductors 118, and a plurality of conductor probes 122.

The first support element 110 may define a boundary of the first body 106. For example, the first support element 110 has a plurality of peripheral walls 110A, where each peripheral wall 110A has a first end 110B and a second end 110C located opposite to the first end 110B. Further, each peripheral wall 110A has a first protruded section 110D extending outwards from the first end 1103, and a second protruded section 110E protruded outwards from the second end 110C. In some examples, the first support element 110 is a non-conductive material, for example, made of a polymer material.

Each receptacle of the plurality of second receptacles 116 is a solid component having a cavity 116A surrounded by a wall 116B. In such examples, the plurality of second receptacles 116 is disposed adjacent to one another and the mutually adjacent walls 116B are attached to one another to form an array of second receptacles. Further, the walls 116B of the plurality the second receptacles 116, which are located proximate to the boundary of the first body 106 are coupled to the first support element 110. In some examples, each receptacle of the plurality of second receptacles 116 is a non-conductive element, for example, made of the polymer material, Each receptacle of the plurality of second receptacles 116 is configured to receive a portion of the plurality of first conductors 118 and the plurality of conductor probes 122.

Each conductor of the plurality of first conductors 118 may be any type of conductors that are capable of connecting the IO ASIC to the downstream components, for example, a first receptacle of a plurality of first receptacle 114, and transferring data (signals or electrical signals) from the IO ASIC to the downstream components. In the example of FIG. 1 each first conductor 118 has a spring portion 118A and a flange portion 118B coupled to the spring portion 118A. In some examples, the spring portion 118A has an overhanging portion 118$A_1$ configured to receive some pads of the IO ASIC. Further, the spring portion 118A and a section in the flange portion 118B of each first conductor 118 are disposed in a respective second receptacle 116, and another section in the flange portion 118B of each first conductor 118 protrudes beyond the respective second receptacle 116. In the example of FIG. 1, the overhanging portion 118$A_1$ is shown as an unicorn section of the spring portion 118A. It may be envisioned that the overhanging portion 118$A_1$ may have other shapes without deviating from the scope of the present disclosure.

Each conductor probe of the plurality of conductor probes 122 may be any type of conductors that are capable of connecting IO ASIC to power conversion/regulation devices in the circuit board 104 via a plurality of pads 124 and a plurality of traces 126 formed in the circuit board 104. In the example of FIG. 1, each conductor probe 122 has a spring portion 122A, a flange portion 122B, and a solder ball portion 122C. In such examples, the spring portion 122A has an overhanging portion 122$A_1$ configured to receive some other pads of the IO ASIC, the flange portion 122B interconnects the spring portion 122A to the solder ball portion 122C. Further, the solder ball portion 122C is soldered to a pad of the plurality of pads 124. In the example of FIG. 1 the overhanging portion 122$A_1$ is shown as an unicorn section of the spring portion 122A. It may be envisioned that the overhanging portion 122$A_1$ may have other shapes without deviating from the scope of the present disclosure.

In some examples, the second body 108 is configured to hold another portion of the electronic socket 102. The second body 108 has a first open end 108A and a second open end 108B. The first open end 108A may be mounted on the circuit board 104 and the second open end 108B may be coupled to a strain relief element 128 (refer to FIG. 2). The second body 108 has a second support element 112, the plurality of first receptacles 114, a plurality of second conductors 120 (refer to FIG. 2), and a plurality of ground bus conductors 130.

The second support element 112 is formed by a plurality of solid elements 112A, each having a cavity (not labeled) surrounded by a wall 112B, In such examples, the plurality of solid elements 112A are disposed adjacent to one another and the mutually adjacent walls 112E are coupled to one another to form an array of solid elements. The second support element 112 may also define a boundary of the second body 108. In some examples, the second support element 112 has a flange 112C that may be used as an alignment feature for the second support element 112 by aligning with a through-hole (not labeled) on the circuit board 104. In one or more examples, the second support element 112 is a non-conductive element, for example, made of the polymer material.

Each receptacle of the plurality of first receptacles 114 is a solid component having a cavity 114A surrounded by a wall 114B. In such examples, the plurality of second receptacles 114 is disposed adjacent to one another and the mutually adjacent walls 114B are attached to one another to form an array of first receptacles. Further, the plurality the first receptacles 114, is disposed in-between the plurality of solid elements 112A and coupled to the plurality of solid elements 112A. In other words, each receptacle of the plurality of first receptacles 114 is interposed between mutually adjacent solid elements of the plurality of solid elements 112A. In such examples, the flange portion 118B protrudes from a first surface 136 of the circuit board 104 to a second surface 138 of the circuit board 104 through a plurality of through-holes 140 (for example, through a plurality of vias 142) in the circuit board 104. In such examples, each receptacle of the plurality of first receptacles 114 is configured to receive another portion of the plurality of first conductors 118. For example, each first receptacle 114 supports the flange portion 118B of the respective first conductor 118. In some examples, the plurality of solid elements 112A applies compressive force along a lateral direction 10, on the plurality of first receptacles 114 such that the flange portions 118B of the plurality of first conductors 118 are positioned along a radial direction 20, and press-fitted to a portion of a respective first receptacle 114. In some examples, each receptacle of the plurality of first receptacles 116 is a conductive element.

Figure 2:
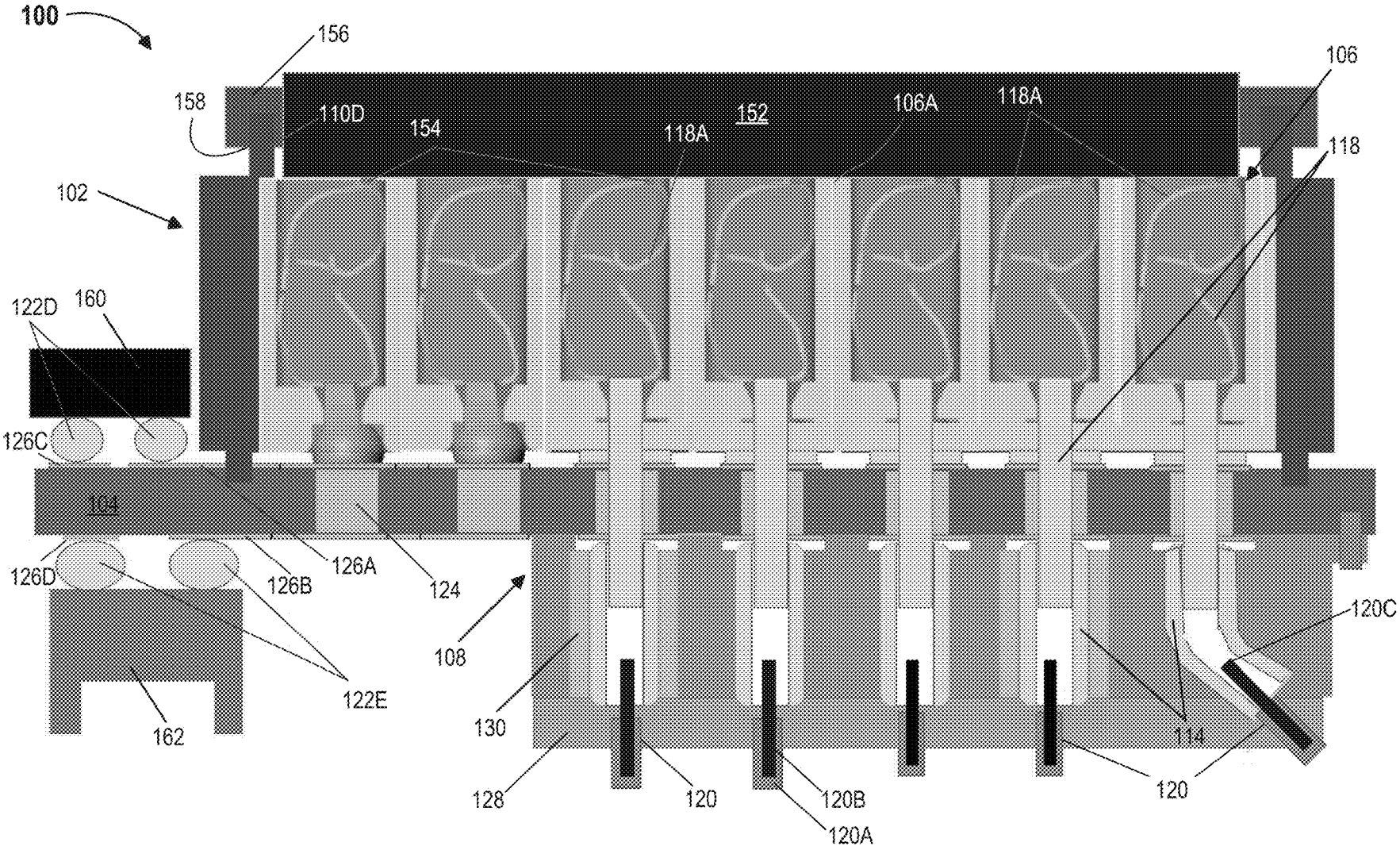
FIG. 2 illustrates a cross sectional view of an electronic packaging assembly having the electronic socket and circuit board of FIG. 1 according to an example implementation of the present disclosure.

Each ground bus conductor of the plurality of ground bus conductors 130 is a solid member having a cavity (not labeled) surrounded by a wall 130A. In some examples, the plurality of ground bus conductors 130 are interconnected on a portion of the strain relief element 128 (not shown). In some examples, at least one of the plurality of ground bus conductors 130 is interposed between and coupled to the mutually adjacent solid elements 112A and the first receptacle 114. In other words, the plurality of ground bus conductors 130 are disposed surrounding a differential pair of first conductors 118E of the plurality of first conductors 118. In some examples, one conductor 118$E_1$ of the pair of differential pair of first conductors 118E may be a positive signal conductor and another conductor 118$E_2$ of the differential pair of first conductors 118E may be a negative signal conductor. The differential pair of first conductors 118E surrounded by the plurality of ground bus conductors 130 may control a differential signal impedance, which may be needed for maintaining a healthy signal integrity from IO ASIC to the plurality of second conductors 120 (as shown in FIG. 2). Further, the plurality of ground bus conductors 130 may be connected to a metal enclosure of the electronic packaging assembly 100 or an electronic system to provide the electronic system grounding. In some examples, each ground bus conductor of the plurality of ground bus conductors 130 is a conductive element.

The circuit board 104 may have a first side 132 and a second side 134 located opposite to the first side 132. Further, the circuit board 104 has the first surface 136 located at the first side 132, and the second surface 138 located opposite to the first surface 136 at the second side 134. The circuit board 104 may have the plurality of through-holes 140 extending through a thickness "T" of the circuit board 104, where the through-holes 140 are disposed adjacent to one another to form an array of first through-holes. As discussed hereinabove, the circuit board 104 includes the plurality of traces 126 disposed on the first and second surfaces 136, 138 of the circuit board 104 and the plurality of vias 124, 142 formed in the plurality of through-holes 140. In one or more examples, the circuit board 104 may be drilled to form the plurality of through-holes 140. In some examples, some of the plurality of through-holes 140 are plated with conductive materials to form the plurality of vias 142. Thus, each of the plurality of vias 142 may have a cavity (not labeled) so as to allow each flange portion 118B to pass through it. Further, each of the plurality of vias 142 has a plurality of pads 143, for example, a top pad 143A and a bottom pad 143B formed on both first and second surfaces 136, 138 of the circuit board 104. In particular, the plurality of pads 143 are formed around both ends of the plurality of vias 142. In one or more examples, the plurality of pads 142 may be isolated pads or may be connected to the grounding pads. In some other examples, some other plurality of through-holes 140 may be filled with a conductive material to form the plurality of vias 124 (filled vias). In such examples, each of the plurality of vias 124 have a plurality of pads 125, for example, a top pad 125A and a bottom pad 125B formed on both first and second surfaces 136, 138 of the circuit board 104. In particular, the plurality of pads 125 are formed around both ends of the plurality of vias 124. Further, the top pad 125A is connected to the respective solder ball 122C of the conductor probe 122 and a top trace 126 of the plurality of traces 126. In such examples, the top trace 126A may be further connected to a voltage conversion/regulation devices (not shown in FIG. 1) disposed on the circuit board 104. Similarly, the bottom trace 1268 of the plurality of traces 126 are connected to the bottom pad 125B connected to the grounding pads of the ground bus conductor 130. The circuit board 104 may further include a plurality of first openings 144 formed on the first surface 136 and at least one second opening 146 formed on the second surface 138.

As discussed hereinabove, the electronic socket 102 may have different types of socket contacts, for example, the plurality of first conductors 118 (wire-terminated contacts), the plurality of conductor probes 122 (solder ball contacts), or the ground bus contacts 130. In some examples, the plurality of first conductors 118 may be used for signal connection, the plurality of conductor probes 122 may be used for power connection, and the plurality of ground bus conductors 130 may be used for grounding connection for the plurality of first conductors 118. In one or more examples, each socket contact in the electronic socket 102 may be an independent contact (i.e., not coupled to other socket contacts in the electronic socket 102, for performing same function, for example, the signal connection, the power connection, or the ground connection.

Referring back to the first body 106, at least one receptacle 114C of the plurality of first receptacles 114, for example, a portion of the at least one receptacle 114C is inclined at an angle "$\alpha_1$" relative to the second surface 138 of the circuit board 104. In some examples, the angle "$\alpha$" may be in a range from about −30 degrees to −45 degrees. Further, one or more receptacles 114D of the plurality of first receptacles 114 are inclined radially along a radial direction 20.

During assembly of the electronic socket 102, the first body 106 is mounted on the first surface 136 of the circuit board 104. Further, the first body 106 is detachably coupled to the first surface 136 of the circuit board 104. For example, the second protruded section 110E of each peripheral wall 110A is disposed within a respective first opening of the plurality of first openings 144 of the circuit board 104 to detachably couple and align the first body 106 to the circuit board 104. In such examples, the plurality of first conductors 118 extends through the plurality of second receptacles 116 and the plurality of through-holes 140 (for example, through the plurality of vias 142, such that a first end 118C of each first conductor 118 is protruded beyond the first surface 136 of the circuit board 104 and the second end 118D of each first conductor 118 is protruded beyond the second surface 138 of the circuit board 104. Further, each of the plurality of first conductors 118 is coupled to the pad of the plurality of pads 143 through the vias 142 of the plurality of vias 142. In some examples, the first portion 118A of the plurality of first conductors 118 is located along the second receptacle 116 and the second portion 118B of the plurality of first conductors 118 is located along the first receptacle 114 and has a wire-terminated contact. Similarly, the plurality of conductor probes 122 extends through the plurality of second receptacles 116. In such examples, each of the plurality of conductor probes 122 is coupled to the trace 126 through the vias 124 of the plurality of vias 124 and the pad 125 of the plurality of pads 125.

The second body 108 is mounted on the second surface 138 of the circuit board 104. Further, the second body 108 is detachably coupled to the second surface 138 of the circuit board 104. For example, at least one fastener 148 is inserted via the through-hole in the flange 112C and the at least one second opening 146 of the circuit board 104 to detachably couple and align the second body 108 to the circuit board 104. In such examples, each first receptacle of the plurality of first receptacles 114 is coupled to the second end 118D of a respective first conductor of the plurality of first conductors 118.

FIG. 2 depicts a cross sectional view of an electronic packaging assembly 100 having the electronic socket 102 and a circuit board 104 of FIG. 1. As discussed herein, the electronic packaging assembly 100 may further include an integrated circuit (IC) device, for example, an input output (IO) application specific integrated circuit (ASIC) 152 having a plurality of pads 154, and a third support element 156 holding the IO ASIC 152. In such examples, the IO ASIC 152 is mounted on the first body 106, for example from the first open end 106A of the first body 106 such that the plurality of pads 154 are in contact with the plurality of first conductors 118 and the plurality of conductor probes 122. In some examples, the plurality of pads 154 contacts the overhanging portion 118$A_1$ of each spring portion 118A and the overhanging portion 122$A_1$ of each spring portion 122. The third support element 156 may hold and detachably couple the IO ASIC 152 to the first body 106 of the electronic socket 102. For example, the first protruded section 110D of each peripheral wall 110A is disposed within a respective second opening of the plurality of first openings 158 of the circuit board 104 to detachably couple and align the first body 106 to the circuit board 104 to the third support element 156.

The electronic packaging assembly 100 may further include a voltage regulation/conversion device 160 coupled to the circuit board 104 via a plurality of solder ball portions 122D. In such examples, the plurality of solder ball portions 122D is further soldered to the top traces 126A, 126C in the circuit board 104. Similarly, the electronic packaging assembly 100 may be further include an electrical connector 162 coupled to the bottom traces 126B, 126D in the circuit board 104 via at least one or more solder ball portions 122E. In some examples, the bottom trace 126D may be a power supply trace or plane on the circuit board 104 and the bottom trace 126B may be ground plane or trace. The electrical connector 162 may be plugged to an electrical source (not shown) to supply power to the electronic packaging assembly 100. In other examples, the bottom trace 126D may be a control/management signal trace on the circuit board 104.

Referring back to the electronic socket 102, the second body 108 may further include a plurality of second conductors 120 and a strain relief element 128. In some examples, each conductor of the plurality of second conductors 120 may be any type of conductors that are capable of interconnecting a cable plug (shown in FIG. 4) to the IO ASIC via the plurality of first receptacles 114 and the plurality of first conductors 118. In the example of FIG. 2, each second conductor 120 has an insulation portion 120A and a conductor portion 120B, where the insulation portion 120A covers the conductor portion 120A. The insulation portion 120A may be removed from an end portion 120C of the plurality of second conductors 120 and the conductor portion 120B may be used to electrically couple (or electrically interconnecting) the plurality of second conductors 120 to the respective plurality of first conductors 118. As used herein, the term "electrically couple" may refer to modularly connecting/attaching two conductors to one another by crimps, conductive solder material, laser welding, or the like.

In some examples, the strain relief element 128 may be used to hold the plurality of second conductors 120 together. Further, the strain relief element 128 may be coupled to at least one of the second support element 108, the plurality of first receptacles 114, or the plurality of ground bus conductors 130. In some examples, the strain relief element 128 is made of epoxy material.

Figure 3:
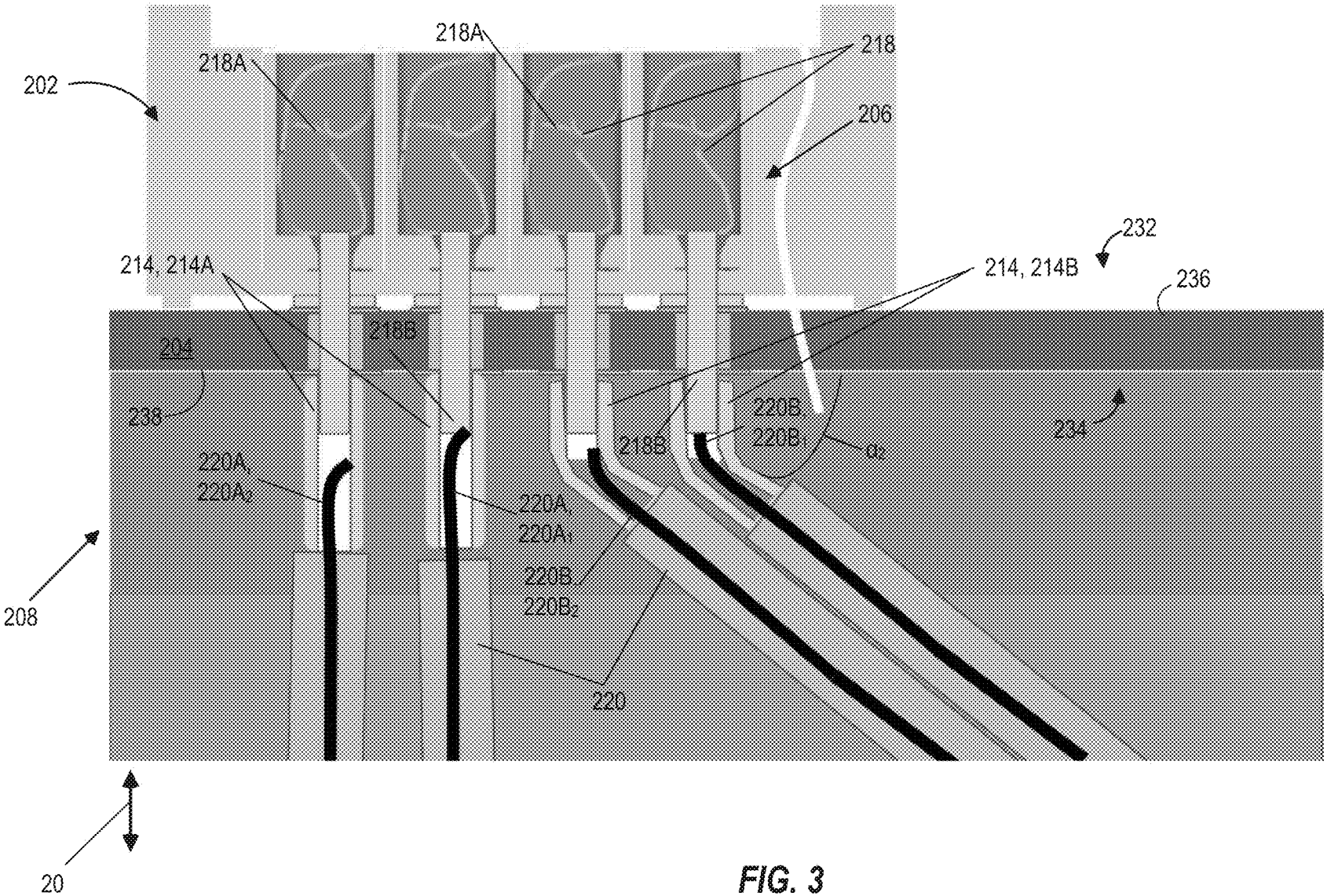
FIG. 3 illustrates a cross sectional view of another electronic packaging assembly having an electronic socket mounted on another circuit board according to an example implementation of the present disclosure.

FIG. 3 depicts a cross sectional view of another electronic socket 202 mounted on another circuit board 204 of another electronic packaging assembly 200. The electronic socket 202 and the circuit board is substantially similar to the electronic socket 102 and the circuit board 104 discussed in the example of FIGS. 1 and 2 other than the way a plurality of first conductors 218 and a plurality of second conductors 220 are interconnected to one another.

In some examples, the electronic socket 202 includes a first body 206 and a second body 208. The first body 206 includes a plurality of first conductors 218. The second body 208 includes a plurality of receptacles 214 (also referred to a plurality of first receptacles) and a plurality of second conductors 220. In such examples, the first body is mounted on a first surface 236 of the circuit board 204 such that a first end 218A of the plurality of first conductors 218 protrude beyond the first surface 236 of the circuit board 204, and a second end 218B of the plurality of first conductors 218 protrude beyond a second surface 238 of the circuit board 204. Similarly, the second body 206 is mounted on a second surface 238 of the circuit board 204. At least two second receptacles 214A of the plurality of second receptacles 214 are positioned along a radial direction 20 and at least two second receptacles 214B of the plurality of second receptacles 214 are inclined at an angle "$\alpha_2$." relative to the second surface 238 of the circuit board 204. Further, each receptacle of the plurality of first receptacles 214 is coupled to the second end 218B of a respective first conductor of the plurality of first conductors 218. Further, the plurality of second conductors 220 is interconnected to the plurality of first conductors 218. It may be noted herein that the length of a plurality of conductor portions 220A, 220B of the plurality of second conductors 220 may be sufficient enough to be placed within respective second receptacles 214A, 214B. The length of each of the plurality of conductor portions 220A, 220B may vary depending on the way each conductor portion 220A, 220B is modularly connected/attached to the respective receptacles 214A, 214B, In one or more examples, the modular connection/attachment may be performed by crimping, laser welding, or soldering. In some non-limiting examples, one or more second conductor portions 220$A_1$, 220$B_1$ of the plurality of second conductors 220 are directly interconnected to the second end 218B of the respective first conductor 218. Similarly, one or more second conductor portions 220$A_2$, 220$B_2$ of the plurality of second conductors 220 are interconnected to the first conductor 218 via the respective receptacle 214.

Figure 4:
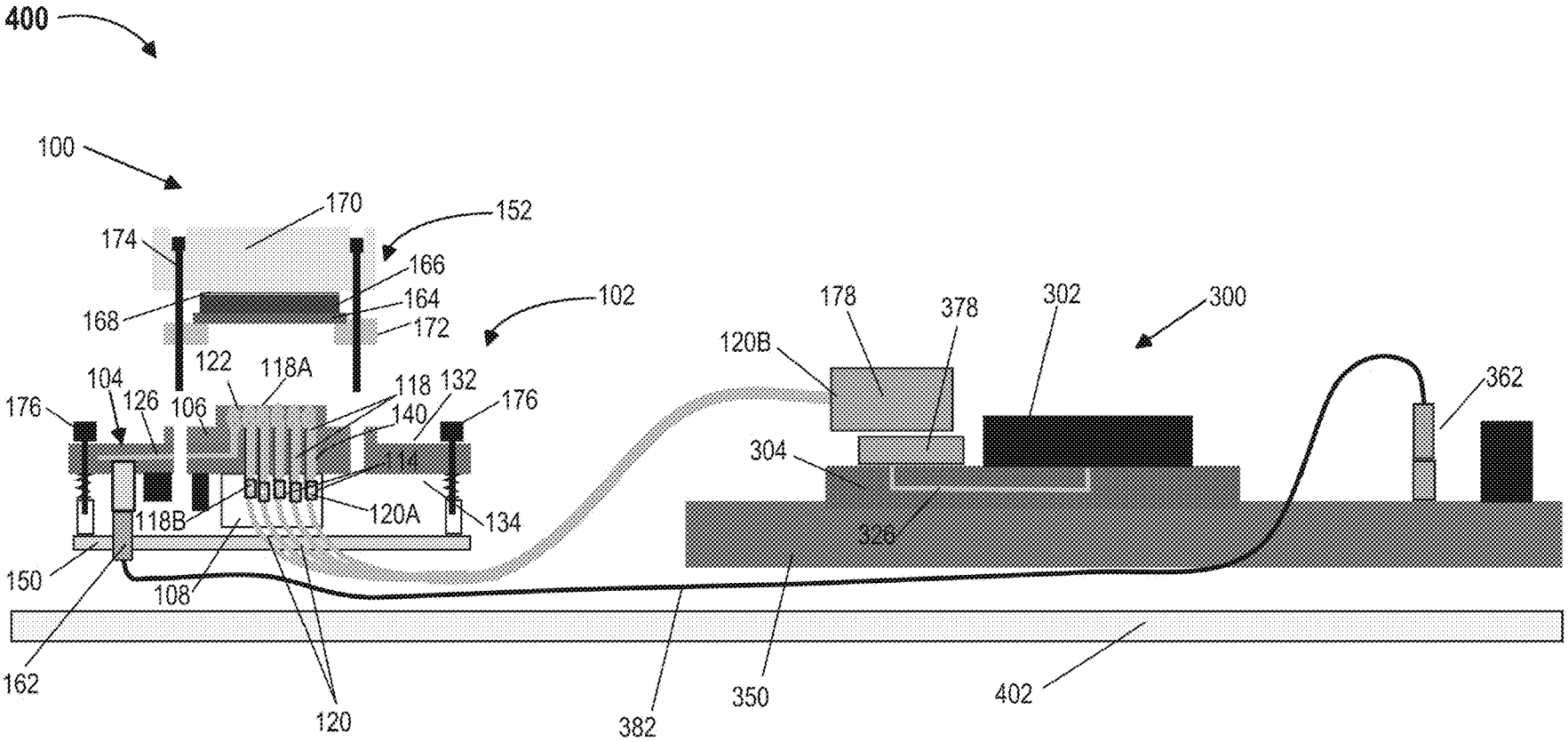
FIG. 4 illustrates a block diagram of an electronic system including a network switch and the electronic packaging assembly of FIG. 2 according to an example implementation of the present disclosure.
Figure 5:
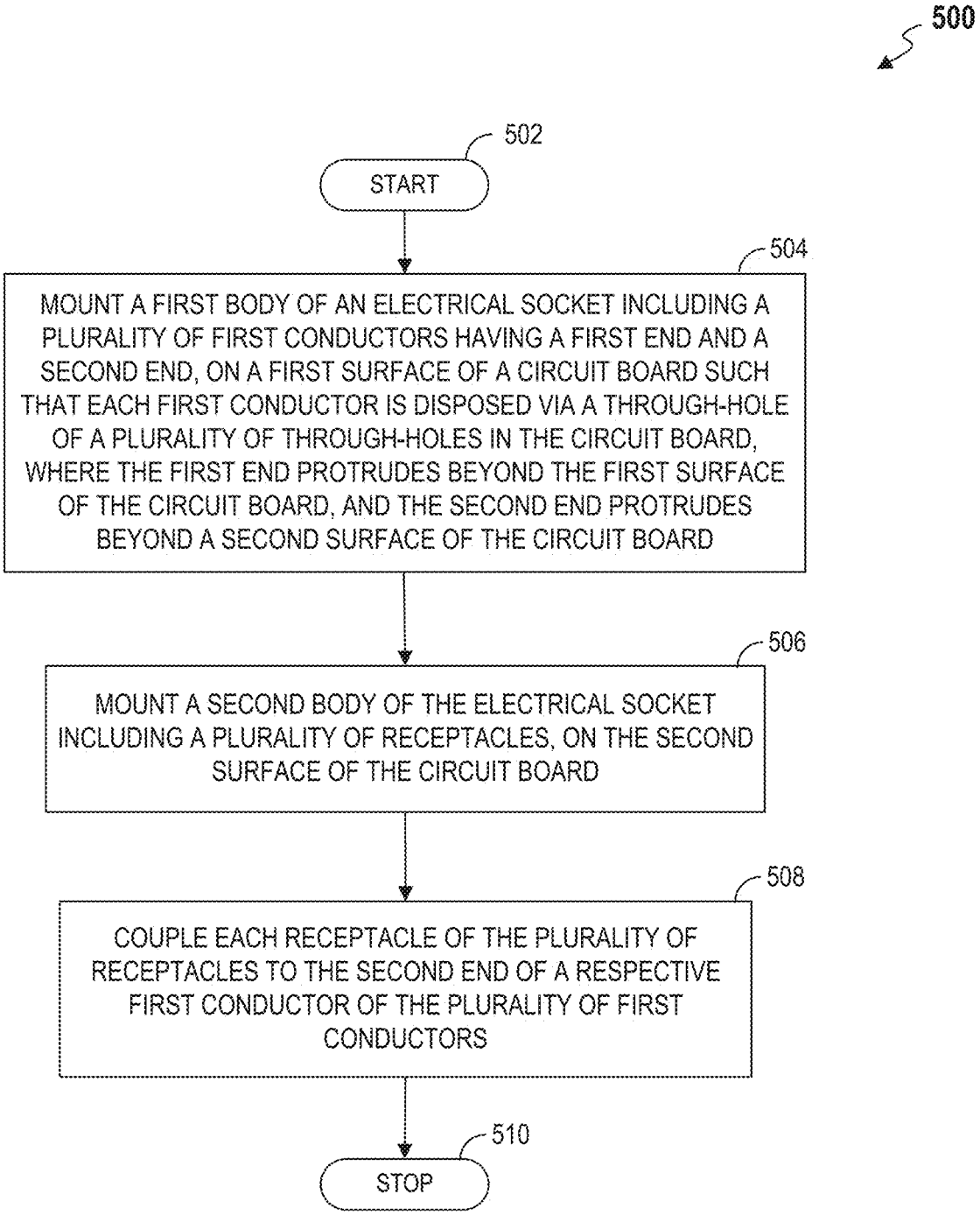
FIG. 5 is a flow diagram depicting a method of assembling an electronic socket on a circuit board of an electronic packaging assembly according to an example implementation of the present disclosure.

FIG. 4 depicts a block diagram of an electronic system 400 including a network switch 300 and the electronic packaging assembly 100 of FIG. 2 disposed within a base 402 of the electronic system 400. In some examples, the electronic system 400 may be a compute infrastructure, such as a server system, a storage system, a compute acceleration system, a communication system, a networking system, or the like. In the example of FIG. 4, the electronic system 400 is the networking system, which may be configured to connect one or more electronic devices, for example, an electronic packaging assembly 100 and a network switch 300 to one another to receive, process, and forward signals (data) to destination devices.

The electronic packaging assembly 100 includes an integrated circuit (IC) device, for example, an input output (IO) application specific integrated circuit (ASIC) 152, an electronic socket 102, a circuit board 104, and a base 150. The IO ASIC 152 includes a substrate 164, for example, an organic substrate or a glass substrate, a processing resource die 166, a thermal interface material 168, a cooling component 170, for example, a heat sink or a cold plate, and a support element 172. The substrate 164 is held by the support element 172 having a through-hole in it. The processing resource die 166 is mounted on the first side of the substrate 164, In some examples, the substrate 164 may have multiple layers of conductor traces and dielectric layers, with fine-pitch pads on a first side of the substrate 164 for the processing resource die 166 to be soldered to, and coarse-pitch pads exposed on a second side of the substrate 164 to interface with the electronic socket 102. Further, the cooling component 170 is mounted on the processing resource die 166 with the thermal interface material 168 interposed there between to establish a thermal contact between the cooling component 170 and the processing resource die 166. The IO ASIC 152 is further coupled to the circuit board 104 via a plurality of fasteners 174 extending through the through-holes in the support element 172 and circuit board 104. The substrate 164 is mounted on the electronic socket 102 such that the course-pitch pads (not shown) in the processing resource die 166 is connected to a plurality of first conductors 118 and the conductor probes 122 of the electronic socket 102. The electronic socket 102 includes a first body 106 mounted on a first surface of the circuit board 104, and a second body 108 mounted on a second surface of the circuit board 104. The first body 106 has the plurality of first conductors 118 and at least one conductor probe 122. The second body 108 has a plurality of second conductors 120 and a plurality of receptacles 114. In such examples, the at least one conductor probe 122 is coupled to a trace 126 in the circuit board 104, and the trace 126 is further coupled to an electrical connector 162. In some examples, the electrical connector 162 is plugged to another electrical source connector 362 of the network switch 300 through a cable 382 to supply power to the electronic packaging assembly 100. Further, each conductor of the plurality of first conductors 118 includes a first end 118A to protrude beyond the first surface 136 of the circuit board 104, and a second end 118B to protrude beyond the second surface 138 of the circuit board 104 to have a wire-terminated contact. For example, each first conductor 118 may extend from the first side 132 to the second side 134 of the circuit board 104 via a respective through-hole in the circuit board 104. In one or more examples, each receptacle of the plurality of first receptacles 114 is coupled to the second end 118B of a respective conductor of the plurality of first conductors 118. The plurality of first conductors 118 is interconnected to the plurality of second conductors 120 through the plurality of receptacles 114. In some examples, the wire-terminated contact of each first conductor 118 is interconnected to the respective second conductor 120 through the respective receptacle 114. In one or more examples, another end portion 120B of the plurality of second conductors 120 may be connected to a cable plug 178. Further, the circuit board 104 is coupled to the base 150 of the electronic packaging assembly 100 through a plurality of fasteners 176. Base 150 may be supported by additional fasteners (not shown) to the base 402.

The network switch 300 may include a switch die 302, a switch integrated circuit (IC) substrate 304, a switch receptacle connector 378, and a switch system board 350. The switch die 302 is mounted on and coupled to the switch IC substrate 304. Further, the switch IC substrate 304 is mounted on and coupled to the base 350. The switch connector 378 is connected to the switch die 302 via traces 326 formed in the switch IC substrate 304. In such examples, the cable plug connector 178 is further interconnected to the switch receptacle connector 378. Additional traces and power planes on the switch system board 350 are not shown for simplicity and such an illustration should not be construed as a limitation of the present disclosure.

Therefore, in one or more examples, the wire-terminated contacts (or second ends 118B) of the plurality of first conductors 118 may allow the IO ASIC 152 to be connected to the cable plug 178 through the second conductors 120 and/or the receptacle 114 in order to receive, process, and forward signals (data) from source devices to destination devices, for example. The second conductors 120 (cable) may reduce signal power losses significantly when compared to the traces 126 of the circuit board 104, which are used in the conventional electronic packing assembly 100 to connect the IO ASIC 152 to the cable plug 178. In some examples, depending on length and signaling rates between the IO ASIC 152 and the cable plug 178, an expensive circuit board 104 materials may be used to lower signal power losses. However, the use of insulated (shielded) cables 120 for transmitting signals allow longer distance connections at lower costs, especially for higher data rates. Thus, lower losses in transmission lines (such as in cables 120) may also means lower signal processing required by the IO ASIC 152, which may enable lower power and lower cost of the electronic packaging assembly 100. Thus, by replacing the traces with the second conductors 120 for the purpose of interconnecting the IO ASIC 152 to the cable plug 178, a high-speed electrical signal connectivity may be achieved, while not incurring signal losses associated with the traces 126, and issues related to space and cost of having traces 126 in the circuit board 104 for routing signals in and out of the IO ASIC 152.

Further, the switch connector 378 connected to the cable plug 178 and the switch die 302 may enable the electronic system 400 to establish a communication between the IO ASIC 152 and the switch ASIC 300 for transmitting, receiving, or processing data there between.

The ball grid array (BGA) contacts (i.e., conductor probes 122) coupled to the traces 126 in the circuit board 104 may allow power conversion/regulation devices to be present on the circuit board 104, while the wire-terminated contacts 118B of the plurality of first conductors 118 may allow the high-speed electrical signals to be routed from IO ASIC 152 to the switch ASIC 300 without using the traces 126 in the circuit board 104 and the traces (not present) in the system board 350. Thus, the electronic socket 102 having the ability to mix the wire-termination contacts (conductors 118) and the BGA contacts (conductor probes 122) makes the electronic socket 102 well equipped to handle power conversions/regulations and substantially high data transfer rates. In other words, the electronic socket 102 may allow separating the processing and management capabilities from the electrical signal connectivity capability of the circuit board 104.

In a traditional electronic system, a large number of traces are needed to route signals between a high port-count switch ASIC and multiple optical transceivers (IO ASIC). Thus, requiring large number of trace layers in switch board and large sized circuit boards. The usage of wire-terminated contacts for optical transceivers (IO ASIC) and cable connections to connect with the switch ASIC board, enables usage of smaller sized circuit board. Further, switch ASIC requires more complex switch IC substrate, whereas the optical transceivers may require less complex circuit board. In addition, the switch IC substrate design may be flexibly connected to different transceiver designs to enable wider range of system product configurations and easy to service/upgrade. Furthermore, the use of cables between optical transceivers and switch ASIC allows flexible placement of the transceivers within the electronic system, e.g., for multiple rows of optical transceivers, for different heat sink heights or cold plate heights for the optical transceivers vs. the switch ASICs.

FIG. 5 is a flow diagram depicting a method 500 of assembling an electronic socket 102 on a circuit board 104 of an electronic packaging assembly 100. It should be noted herein that the method 500 is described in conjunction with FIGS. 1-2.

The method 500 starts at block 502 and continues to block 504. At block 504, the method 500 includes mounting a first body of an electrical socket including a plurality of first conductors having a first end and a second end, on a first surface of a circuit board such that each first conductor is disposed via a through-hole of a plurality of through-holes in the circuit board, where the first end protrudes beyond the first surface of the circuit board, and the second end protrudes beyond a second surface of the circuit board, as described in FIGS. 1-2. In one or more examples, each conductor of the plurality of first conductors may be disposed from first side to the second side of the circuit board by extending each first conductor through a respective through-hole of the plurality of through-holes in the circuit board.

Further, the method 500 continues to block 506. At block 506, the method 500 includes mounting a second body of the electrical socket including a plurality of receptacles, on the second surface of the circuit board. In one or more examples, the first body and the second body are disposed spaced apart from each other, when the electronic socket is mounted on the circuit board. In other words, the first body and the second body are discrete portions of the electronic socket.

The method 500 moves to block 508. At block 508, the method 500 includes coupling each receptacle of the plurality of receptacles of the second body, to the second end of a respective first conductor of the plurality of first conductors. In some examples, the second body may apply compressive force on the plurality of first receptacles such that the plurality of first conductors are positioned, and press-fitted to the plurality of first conductors.

The method 500 may further include the steps of interconnecting the plurality of first conductors to a plurality of second conductors of the electrical socket. In some examples, one end of each second receptacle is interconnected directly to the respective first conductor or indirectly to the respective first conductor via the receptacle. Another end of each of the plurality of second conductors is coupled to a switch receptacle connector. Further, the method 500 includes holding the plurality of second conductors together via a strain relief element of the electrical socket, and coupling the strain relief element to at least one of the second body or the plurality of first conductors. In some examples, the electronic socket may further include interposing a plurality of ground bus conductors between a support element and the plurality of first receptacles. In such examples, the plurality of ground bus conductors may be further connected to a metal enclosure of the electronic packaging assembly or an electronic system to perform grounding function of discharging an excess current flowing along the electronic socket. The method 500 ends at block 510.

Various features as illustrated in the examples described herein may be implemented in a system, such as an electronic system having an electronic packaging assembly and a network switch. The electronic socket having wire-terminated contacts (i.e., first conductors) to interconnect with the cable plug through cables (i.e., second conductors), instead of interconnecting the first conductors to the cable plug via traces, may allow an IO ASIC of an electronic packaging assembly (e.g., an optical transceiver) to be connected to the cable plug through the first and second conductors. The cables (second conductors) may reduce signal power losses by an order of magnitude when compared to the traces of the circuit board. Further, by replacing the traces with the second conductors for the purpose of interconnecting the IO ASIC to the cable plug, a high-speed electrical signal connectivity may be achieved, while not incurring signal losses associated with the traces, and issues related to space and cost of having traces in the circuit board for routing signals in and out of the IO ASIC.

Further, the electronic socket having the ability to mix the wire-termination contacts (conductors) and the BGA contacts (conductor probes) makes the electronic socket well equipped to handle power conversions/regulations and substantially high data transfer rates. In other words, the BGA contacts may allow power conversion/regulation devices to be present on the circuit board, while the wire-terminated contacts may allow the high-speed electrical signals to be routed without using the traces on the circuit board. Thus, the electronic socket of the present disclosure may allow separating the processing and management capabilities from the electrical signal connectivity capability of the circuit board. Further, the electronic socket having a flexible population of the BGA contacts and the wire-terminated contacts may enable such electronic socket to have a wide application base.

In the foregoing description, numerous details are set forth to provide an understanding of the subject matter disclosed herein. However, implementation may be practiced without some or all of these details. Other implementations may include modifications, combinations, and variations from the details discussed above. It is intended that the following claims cover such modifications and variations.

What is claimed is:

1. An electrical socket for a circuit board, comprising:

a first body mountable on a first surface of the circuit board and comprising a plurality of first conductors, wherein each first conductor comprises a first end to protrude beyond the first surface of the circuit board, and a second end to protrude beyond a second surface of the circuit board; and a second body mountable on the second surface of the circuit board, wherein the second body comprises a plurality of first receptacles, wherein each first receptacle is coupled to the second end of a respective first conductor of the plurality of first conductors, and wherein the first body further comprises a first support element detachably coupled to the first surface of the circuit board and a plurality of second receptacles attached to one another and coupled to the first support element.

2. The electrical socket of claim 1, wherein the first body further comprises a plurality of conductor probes coupled to a plurality of traces disposed on the first surface of the circuit board, and wherein the plurality of the second receptacles receives a first portion of the plurality of first conductor and the plurality of conductor probes.

3. The electrical socket of claim 1, wherein the second body further comprises a second support element detachably coupled to the second surface of the circuit board, and wherein the plurality of first receptacles is attached to one another and coupled to the second support element.

4. The electrical socket of claim 3, wherein the plurality of first receptacles receives an end portion of a plurality of second conductors of the electrical socket and a second portion of the plurality of first conductors, and interconnects the plurality of first conductors to the plurality of second conductors, wherein the plurality of second conductors is coupled to a cable plug.

5. The electrical socket of claim 4, wherein the second body further comprises a plurality of ground bus conductors interposed between the second support element and the plurality of first receptacles.

6. The electrical socket of claim 5, wherein the second body further comprises a strain relief element holding the plurality of second conductors together, and wherein the strain relief element is further coupled to at least one of the second support element, the plurality of first receptacles, or the plurality of ground bus conductors.

7. The electrical socket of claim 1, wherein a portion of at least one first receptacle of the plurality of first receptacles is inclined at an angle relative to the second surface of the circuit board.

8. The electrical socket of claim 1, wherein each of the plurality of first conductors is disposed via a through-hole of a plurality of through-holes in the circuit board such that the first end is protruded beyond the first surface of the circuit board and the second end is protruded beyond the second surface of the circuit board.

9. An electronic packaging assembly comprising:

a circuit board having a plurality of through-holes;

an electrical socket coupled to the circuit board, wherein the electrical socket comprises:

a first body mounted on a first surface of the circuit board and comprising a plurality of first conductors having a first end and a second end, wherein each first conductor is disposed via a through-hole of the plurality of through-holes such that the first end is protruded beyond the first surface of the circuit board, and the second end is protruded beyond a second surface of the circuit board; and a second body mountable on the second surface of the circuit board, wherein the second body comprises a plurality of first receptacles, wherein each first receptacle is coupled to the second end of a respective first conductor of the plurality of first conductors; and a plurality of second conductors having an end portion interconnected to the plurality of first conductors, wherein the plurality of second conductors is coupled to a cable plug.

10. The electronic packaging assembly of claim 9, wherein the first body further comprises a first support element detachably coupled to the first surface of the circuit board, and a plurality of second receptacles attached to one another and coupled to the first support element.

11. The electronic packaging assembly of claim 10, wherein the first body further comprises a plurality of conductor probes coupled to a plurality of traces disposed on the first surface of the circuit board, and wherein the plurality of second receptacles receives a first portion of the plurality of first conductors and the plurality of conductor probes.

12. The electronic packaging assembly of claim 10, wherein the second body further comprises a second support element detachably coupled to the second surface of the circuit board, and wherein the plurality of first receptacles is attached to one another and coupled to the second support element.

13. The electronic packaging assembly of claim 12, wherein the plurality of first receptacles receives the end portion of the plurality of second conductors and a second portion of the plurality of first conductors, and interconnects the plurality of first conductors to the plurality of second conductors.

14. The electronic packaging assembly of claim 13, wherein the second body further comprises a plurality of ground bus conductors interposed between the second support element and the plurality of first receptacles.

15. The electronic packaging assembly of claim 14, wherein the second body further comprises a strain relief element holding the plurality of second conductors together, and wherein the strain relief element is further coupled to at least one of the second support element, the plurality of first receptacles, or the plurality of ground bus conductors.

16. The electronic packaging assembly of claim 9, wherein a portion of at least one first receptacle of the plurality of first receptacles is inclined at an angle relative to the second surface of the circuit board.

17. A method comprising:

mounting a first body of an electrical socket comprising a plurality of first conductors having a first end and a second end, on a first surface of a circuit board such that each first conductor is disposed via a through-hole of a plurality of through-holes in the circuit board, where the first end protrudes beyond the first surface of the circuit board, and the second end protrudes beyond a second surface of the circuit board;

mounting a second body of the electrical socket comprising a plurality of receptacles, on the second surface of the circuit board;

coupling each receptacle of the plurality of receptacles to the second end of a respective first conductor of the plurality of first conductors; and interconnecting the plurality of first conductors to a plurality of second conductors of the electrical socket, wherein the plurality of second conductors is further coupled to a cable plug.

18. The method of claim 17, further comprising:

holding the plurality of second conductors together via a strain relief element of the electrical socket; and coupling the strain relief element to at least one of the second body or the plurality of first conductors.

19. The method of claim 17, wherein mounting the first body on the first surface of the circuit board further comprises coupling a plurality of conductor probes of the first body to a plurality of traces disposed on the first surface of the circuit board.

* * * * *